US005800893A

United States Patent [19]

Harden

[11] Patent Number: 5,800,893

[45] Date of Patent: Sep. 1, 1998

[54] DOUBLE-BLIND LABEL AND METHOD FOR DOUBLE-BLIND LABELLING

[75] Inventor: John Michael Harden, Knightdale, N.C.

[73] Assignee: The Standard Register Company, Dayton, Ohio

[21] Appl. No.: 495,816

[22] Filed: Jun. 27, 1995

[51] Int. Cl.[6] ..... B42D 15/00; G09F 3/00

[52] U.S. Cl. ..... 428/40.1; 283/81; 283/101; 283/105; 434/349; 428/41.6; 428/41.7; 428/41.8; 428/41.9; 428/42.1; 428/42.2; 428/42.3; 428/43; 428/192; 428/194; 428/914

[58] Field of Search ..... 283/81, 101, 105; 434/349; 428/40.1, 416, 41.7, 41.8, 41.9, 42.1, 42.2, 43, 192, 194, 914

[56] References Cited

U.S. PATENT DOCUMENTS

| | | | |
|---|---|---|---|
| 3,593,443 | 7/1971 | Demetrius, Jr. et al. | 40/299 |
| 3,740,081 | 6/1973 | Whipperman | 283/6 |
| 3,941,278 | 3/1976 | Oglander et al. | 221/73 |
| 4,637,635 | 1/1987 | Levine | 283/101 |
| 4,700,976 | 10/1987 | Loose | 283/101 |
| 5,178,419 | 1/1993 | Bolnick et al. | 283/81 |
| 5,284,689 | 2/1994 | Laurash et al. | 428/40.1 |
| 5,314,560 | 5/1994 | Pritchet | 283/81 |

OTHER PUBLICATIONS

Declaration of John M. Harden; attachments—sample labels, purchase order.

*Primary Examiner*—Nasser Ahmad

*Attorney, Agent, or Firm*—Killworth, Gottman, Hagan & Schaeff, L.L.P.

[57] ABSTRACT

A double-blinded label and a method for double-blind labelling a container are provided. The double-blind label comprises a multilayer identification and a multilayer double-blinded label. The double-blind label may include a tab extending beyond an edge of the label to secure the label when placed on a container. The double-blind label may also include a protective layer on one portion of the label to allow easy removal of that portion from the container while another portion of the label remains adhered to the container. The method comprises first printing on the identification label, attaching the blinding label then placing the label on a container. In a preferred embodiment, the method is continuous.

19 Claims, 6 Drawing Sheets

DOUBLE-BLIND LABEL AND METHOD FOR DOUBLE-BLIND LABELLING

BACKGROUND OF THE INVENTION

This invention relates to a double-blind label and a method for double-blind labelling a container, more particularly, this invention relates to a double-blind label having a separate identification label and a blinding label.

Labels are generally designed to convey information to the individual or individuals handling a labelled container or package. However, at times it is necessary to temporarily conceal the information on the label from casual observation. A prime example of such an instance is in the clinical testing of experimental drugs. In the clinical testing of experimental drugs, it is important that neither the patient nor the individual administering the medication know the contents of the medication received. However, in the event of an adverse reaction, it is essential that the precise medication and dosage administered to each patient can be identified.

Accordingly, double-blind labelling has been developed. Double-blind labelling traditionally involves blinding or obscuring from view the identity of the medication in the container to which the double-blind label has been attached. A prior art double-blinded label is shown in FIG. 1. In FIG. 1, a double-blinded label 10 is provided comprising a label portion 12 and a blinding portion 14. The label portion is divided by a line of weakness 11 into a container portion 13 designed to remain adhered to the container and a record portion 15 designed to be removed from the container and fixed to a medical record or file. The label portion comprises a label face stock 16, the upper surface of which has images 18 printed thereon. The lower surface of the label stock 16 is coated with a pressure sensitive adhesive 20 for applying the label to a container surface. The adhesive 20 is protected by a release liner 22.

The blinding portion 14 comprises a first paper ply layer 24. The upper surface of the first paper ply layer 24 may contain a pre-printed camouflaged image 26 which is in turn covered with a top paper ply layer 28. The first paper ply 24 and the second paper ply 28 are held to the label face stock 16 and each other by an adhesive material 30. The lower surface of the first paper ply layer 24 is coated with a carbon image coating 32. Information identifying the medication is printed onto the label by passing the label through an impact printing system. The impact printer impacts on the carbon image coating 32 which then provides an image 34 on the label face stock 16. The label may then be applied to a container for the medication such as a vial or the like.

However, this prior art label has several drawbacks which make it less than desirable as a double-blind label. First, the label thermal printer must be employed with an impact printer system, not with a laser or ink jet system which normally provides a higher quality image than an impact printer. Secondly, the label cannot be conveniently attached to the medicine container. A rubber band or heat shrink sleeve must be employed. If the release liner 22 is removed to use adhesive 20 to attach the label to the container, the adhesive 20 will permanently attach itself to the bottle and the record portion of the label will be destroyed during removal from the bottle. Third, the label cannot be employed in an automated system and must be attached by hand to the container. Hand application requires considerable time and expense. Further, hand application is much slower than an automated system and thus creates considerable problems for major drug manufacturers who require hundreds of thousands of experimental drug tests for Food and Drug Administration approval of experimental medication.

There have been attempts to address these problems in the art. U.S. Pat. No. 4,700,976 to Loose discloses a blinded label. The Loose label comprises a base label stock having information printed on the upper surface. The information is blinded with an opaque coating or layer of opaque material. The lower surface of the base stock is coated with an adhesive material. The adhesive in the portion which will remain adhered to the container is a permanent adhesive. The portion of the label which wraps around the container and overlays the remaining label portion is provided with a weaker adhesive to allow for removal of this portion of the label.

While the Loose label allows for automated printing, it is not a satisfactory label due the use of the weak, releasable adhesive on the removable portion of the label. This portion of the label is designed for application to a medical record or chart of the patient. If a weak releasable adhesive is employed, the removable portion of the label will not properly and strongly adhere to the medical chart or record, and may become lost or damaged.

Accordingly, the need remains for an improved and satisfactory double-blind label which is ideally suited for use in an automated printing system.

SUMMARY OF THE INVENTION

This need is met by the present invention wherein a double-blind label and a method for double-blind labelling is provided. The label can be used in modern printing systems such as with laser, ink jet and thermal transfer printers. Further, the label can be printed, blinded and applied to a container in a continuous, fully automated process. Also, the label employs a permanent or pressure sensitive adhesive to hold the record portion of the label to a medical record or file.

In accordance with a first aspect of the present invention, a double-blinded label is provided. The double-blind label comprises an identification label having first and second end edges and is divided into at least first and second sections. The identification label further comprises (i) a layer of face stock. The face stock has first and second surfaces and a printed image provided on at least a portion of the first surface of the face stock in the first section of the label. The label also includes (ii) an adhesive layer having first and second surfaces. The first layer of the adhesive layer is in contact with the second surface of the face stock.

A protective layer (iii) having first and second surfaces is also included in the identification label. The protective layer lies in register with the first section of the label but not in register with the second section of the label. At least a portion of the first surface of the protective layer has a release coating thereon. Lastly, the identification layer includes (iv) a base sheet having a first surface. The portion of the first surface of the base sheet which is lying in register with the first section of the label is coated with a clean release adhesive and is in contact with the protective layer.

The double-blind label also includes a blinding label adhered over the printed image on the identification label. The blinding label comprises an opaque layer having first and second surfaces and an adhesive layer having first and second surfaces. The first surface of the adhesive layer is in contact with the second surface of the opaque layer and the second surface of the adhesive layer is disposed over the printed image.

The first and second sections of the identification label may be divided by a line of weakness. The portion of the first surface of the base sheet lying in register with the second section of the identification label may also includes a release coating thereon. The protective layer may be a release liner and the first surface of the release liner may be in contact with the portion of the second surface of the adhesive layer which is lying in register with the first section of the identification label.

Alternatively, the protective layer may be a face sheet having first and second portions. The first portion of the face sheet lies in register with the face stock to comprise the first section of the identification label. The second portion of the face sheet comprises the second section of the identification label. The second surface in the second portion of the face sheet may also be coated with an adhesive material.

The opaque layer of the blinding label may be an opaque coating on a transparent film. Preferably, the opaque coating is a scratch-off coating. The opaque layer may further include a protective covering on the opaque coating. The blinding label may be adjacent the first end edge of the identification label. A portion of the double-blind label may be provided which extends a distance beyond the first end edge forming a tab. The tab may extend from the opaque layer, the face stock layer or the protective layer. The base sheet then may also extend a distance beyond the first end edge coextensive with the tab.

In accordance with a second aspect of the present invention, a double-blinded label is provided. The double-blind label comprises an identification label having first and second end edges and is divided into at least first and second sections. The identification label comprises (i) a layer of face stock. The face stock has first and second surfaces. A printed image is provided on at least a portion of the first surface of the face stock in the first section of the label. The identification label also includes (ii) an adhesive layer having first and second surfaces. The first layer of the adhesive layer is in contact with the second surface of the face stock. Lastly, the identification label comprises (iii) a base sheet having a first surface. The first surface of the base sheet is coated with a release coating and extends a distance beyond the first end edge of the identification label.

For this embodiment, the double-blind label also includes a blinding label adhered over the printed image of the identification label. The blinding label comprises (i) an opaque layer having first and second surfaces. The blinding label also includes (ii) an adhesive layer having first and second surfaces. The first surface of the adhesive layer is in contact with the second surface of the opaque layer and the second surface of the adhesive layer is disposed over the printed image. A portion of the double-blind label may be extended a distance beyond the first end edge forming a tab.

The identification label may further include a protective layer disposed between the adhesive layer and the base sheet in the portion of the label lying in register with the first section. The protective layer has first and second surfaces and a release coating on the first surface. The portion of the base sheet lying in register with the first section of the identification label may include a clean release adhesive on the first surface. The opaque layer of the blinding label may be an opaque coating on a transparent film. Preferably, the opaque coating is a scratch-off coating. The opaque layer may further include a protective covering on the opaque coating. The tab may extend from the opaque layer, the face stock or the protective layer.

The present invention also provides a method for applying double-blind labels as described above with respect to the first and second embodiments to containers. The method comprises providing such an identification label which has first and second end edges and which is divided into at least first and second sections.

The identification label is passed through a printing system to provide a printed image on at least a portion of the first surface of the face stock in the first section of the identification label. The identification label is then blinded to form a double-blinded label by adhering a blinding label as described above over the printed image on the identification label. Finally, the double-blinded label is applied to a container.

The steps of providing an identification label, passing the identification label through a printing system, blinding the identification labels and applying the double-blinded labels to a container may be continuous.

Preferably, the printing system employs a laser, ink jet, or thermal transfer printer. The opaque layer of the blinding label may be an opaque coating on a transparent film. The opaque coating is preferably a scratch-off coating. The opaque layer may further include a protective covering on the opaque coating.

Accordingly, it is an object of the present invention to provide a double-blinded label which allows the use of non-impact printers. It a further object of the present invention to provide a method for double-blind labelling a container. It is a feature of the present invention to employ a double-blind label having a tab extending from the edge of the label. It is a further feature of the present invention to employ a continuous method for double-blind labelling a series of containers.

DETAILED DESCRIPTION OF THE PREFERRED EMBODIMENTS

The present invention relates to a double-blind label and a method for double-blind labelling. The double-blind label of the present invention provides a record portion that will strongly adhere to a medical record or chart. In addition, the double-blind label of the present invention may employ a tab extending from the label to releasably secure the label to itself on a container.

Figure 1:
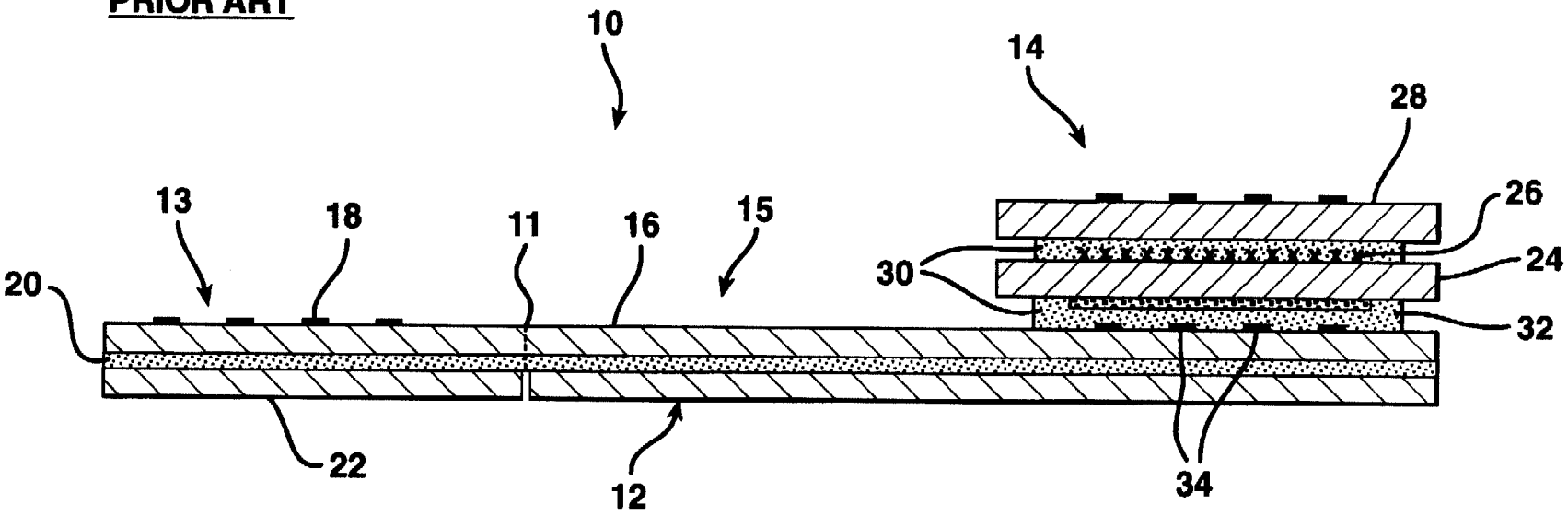
FIG. 1 PRIOR ART
FIG. 1 is a cross-sectional view of a prior art double-blinded label.
Figure 2:
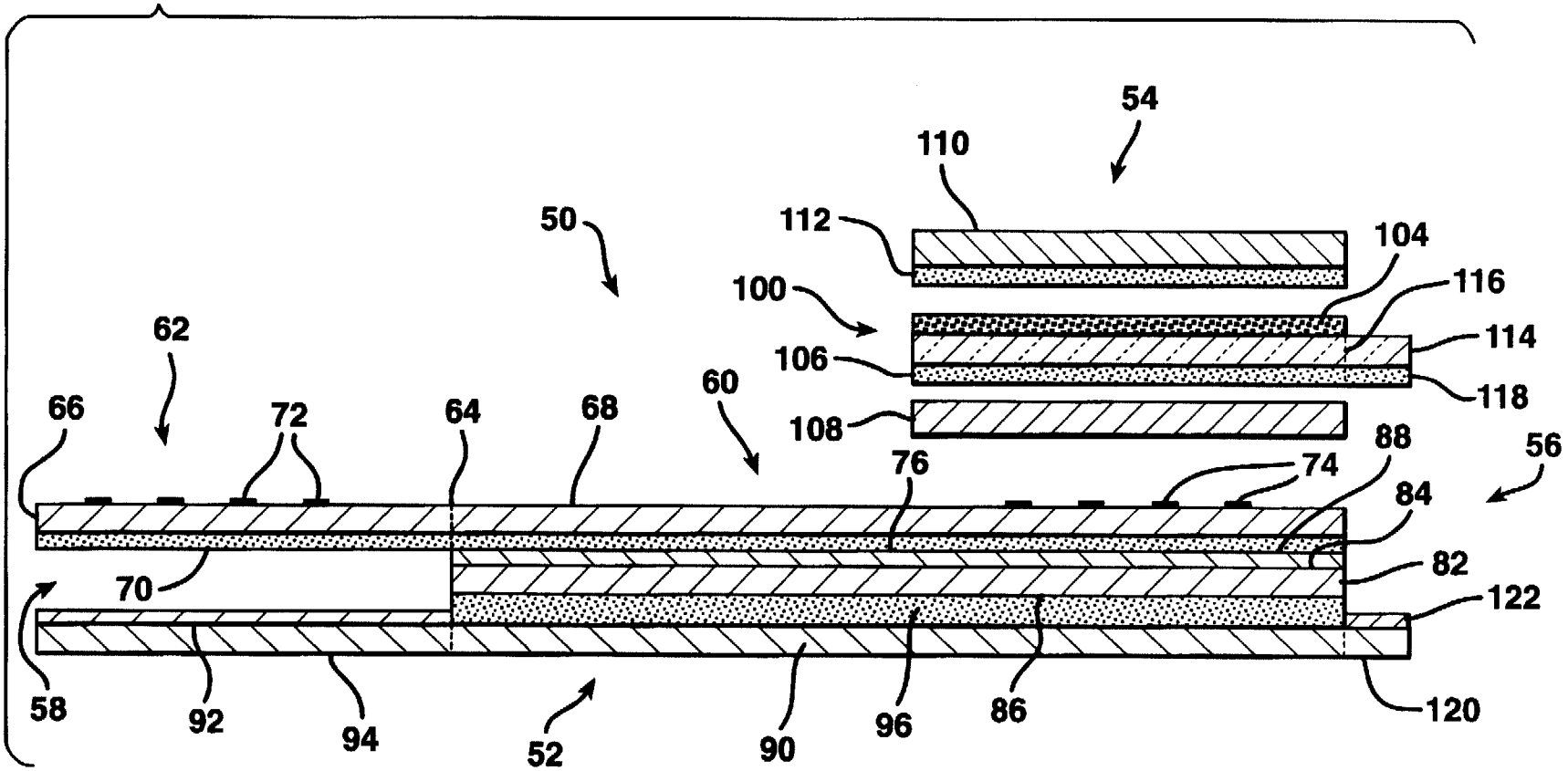
FIG. 2 is a cross-sectional view of a double-blinded label of the present invention.
Figure 6:
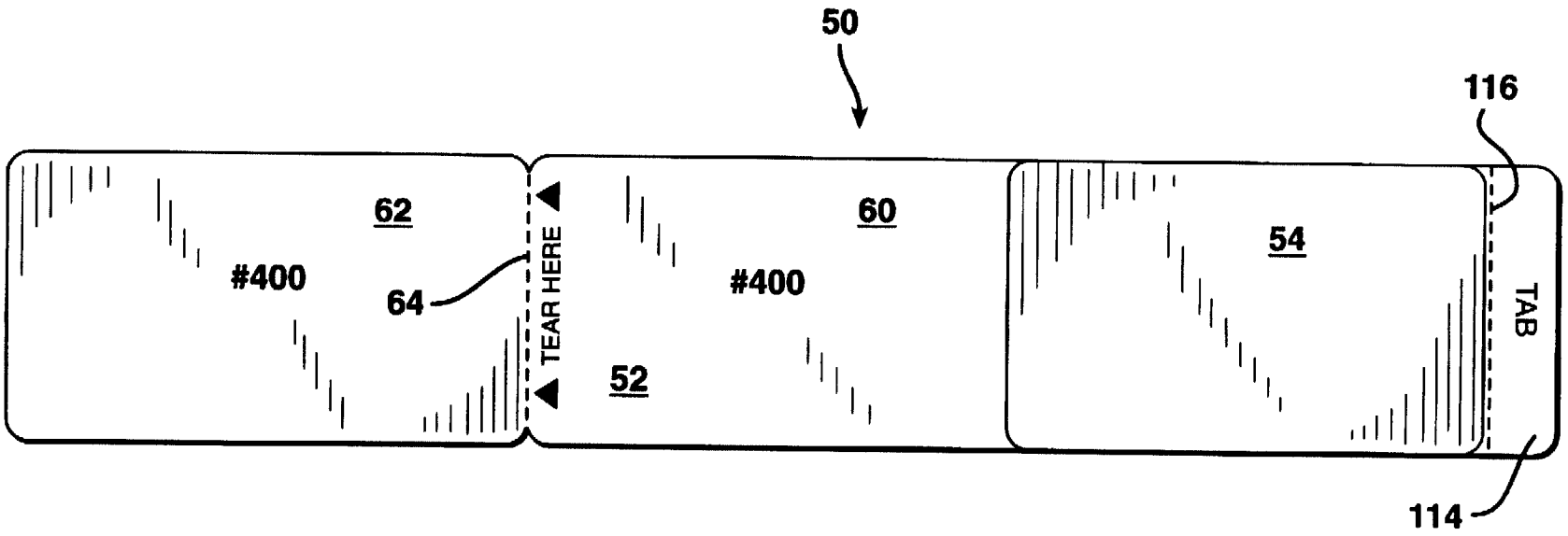
FIG. 6 is a top view of the double-blinded label of the present invention.

Turning to FIGS. 2 and 6, the preferred label of the present invention is shown. As will be understood, layer thicknesses have been exaggerated and are not to scale to aid in clearly depicting all of the layers in the label. The double-blind label 50 comprises an identification label 52 and a blinding label 54. Of course, one of ordinary skill in the art will recognize that if a double-blind label is not desired, then identification label 52 can be used without the use of blinding label 54. Thus, identification label 54 may be employed where a label having a detachable record portion is desired such as in shipping applications. The identification label 52 has first end portion 56 and second end portion 58. A line of weakness 64, such as perforations or cuts, divides identification label 52 into at least a first section 60 and a second section 62. Additional lines of weakness (not shown) may be employed to divide the identification label into more than two sections.

Identification label 52 is a multi-layer label. Identification label 52 comprises a layer of face stock 66 having first and second surfaces 68 and 70. The first surface 68 of face stock 66 is suitable for receiving printed images from a printing device. Multiple printed images 72 may be provided on both the first and second sections, 60 and 62, of the identification label 52. Such printed images may include both variable and nonvariable information. Nonvariable information is information which remains the same from label to label, such as name of the supplier and instructional information, while variable information is information which will vary from label to label, such as the identification numbers and contents.

A printed image 74 to be blinded or camouflaged is provided in at least a portion of the first section 60 on face stock 66. This image generally includes information, such as the specific identity and dosage amount of the material in the container, which must remain blinded or camouflaged to ensure the integrity of the testing.

The identification label 52 also includes an adhesive layer 76 adjacent the face stock layer 66. The adhesive layer 76 includes a first surface 78 and a second surface 80. The first surface 78 of the adhesive layer 76 is in contact or adjacent the second surface 70 of face stock 66. The adhesive layer 76 may be any of a number of conventional compositions which are known in the art. Preferably, adhesive layer 76 is a pressure sensitive adhesive material.

A protective layer 82 is also provided in the identification label 52. The protective layer 82 has a first surface 84 and a second surface 86. The protective layer 82 comprises a release liner having a release coating 88 on first surface 84 of the protective layer. The release coating 88 allows the second surface 80 of adhesive layer 76 to be releasably adhered to protective layer 82. The protective layer 82 lies in register with the first section 60 of the identification label 52, yet not in register with the second section 62.

The final layer of the identification label 52 is a base sheet 90. Base sheet 90 has a first surface 92 and a second surface 94. The portion of the first surface 92 of base sheet 90 lying in register with first section 60 of the identification label 52 is in contact with the protective layer 82. This portion of the first surface 92 of base sheet 90 is coated with a clean release adhesive 96. Clean release adhesives are adhesives which provide a releasable adhesive bond yet are non-tacky. Clean release adhesives as employed in the application are described in U.S. Pat. Nos. 4,833,122 and 4,940,690, the disclosures of which are both herein incorporated by reference. Thus, the base layer may be adhered to the protective layer and removed from the identification label while leaving the second surface 86 of protective layer 82 non-tacky.

The double-blinded label 50 of the present invention also includes a blinding label 54 which is placed over the printed image 74 which is to be blinded or camouflaged. The blinding label 54 also comprises a multilayer label. The blinding label 54 includes an opaque layer 100 for blinding or camouflaging the image 74. The opaque layer 100 may be any suitable material for blinding the image 74. Preferably, the opaque layer 100 is a transparent film 102 with a scratch-off, opaque coating 104. Thus, the double-blinded label 50 may be unblinded by scratching off the coating 104 or by coating the back of 110 with a permanent adhesive 112 which when 110 is peeled off will remove most of the scratch-off coating. This feature allows for faster unblinding of the info under this section. The blinded image 74 is then visible through the transparent film 102. Opaque coating 100 may, of course, be other blinding material such as a paper layer.

The blinding label 54 also includes an adhesive layer 106. The adhesive layer 106 is in contact with the lower surface of the opaque layer 100, preferably the transparent film 102. The adhesive layer 106 may be any suitable adhesive. Preferably, adhesive layer 106 is a pressure sensitive or permanent adhesive. Adhesive layer 106 holds blinding label 54 onto the identification label 52 securely so that the image 74 is blinded. Adhesive layer 106 may be protected by a release liner 108 when the blinded label 54 is not adhered to the identification label. The release liner 108 is, of course, removed to apply blinding label 54 over image 74.

The opaque layer 100 may be protected on its upper surface by a protective coating 110. The protective coating 110 prevents the opaque layer 100, such as scratch-off coating 104, from being accidentally removed and causing the double-blinded label 50 to be unblinded. The protective coating 110 may includes various papers or films. The protective coating 110 is held in place on the opaque layer 100 by a layer of adhesive 112. Adhesive layer 112 may, again, be any suitable adhesive, but is preferably a pressure sensitive adhesive.

In a preferred embodiment of the present invention, the double-blinded label 50 may include a tab 114. Tab 114 comprises a portion of either blinding label 54 or identification label 52 which extends beyond the first end portion 56 of the identification label 52. Tab 114 may extend from the face stock 66 or the protective layer 82. Preferably, however, tab 114 extends from the opaque layer 100 of blinding label 54. Tab 114 is preferably separated from the blinding label 54 or the identification label 52 by a line of weakness 116, such as perforations or the like. Tab 114 includes a layer of adhesive 118, preferably a pressure sensitive adhesive.

To protect the adhesive 118 on tab 114, a portion 120 of base sheet 90 extends a distance beyond first end portion 56 to be coextensive with tab 114. This portion 120 of base sheet 90 is coated on its upper surface with a release coating 122. Release coating 122 comes into contact with adhesive 118 and protects adhesive 118 until the point in time in which base sheet 90 is removed to apply the double-blinded label 50 to a container.

Figure 3:
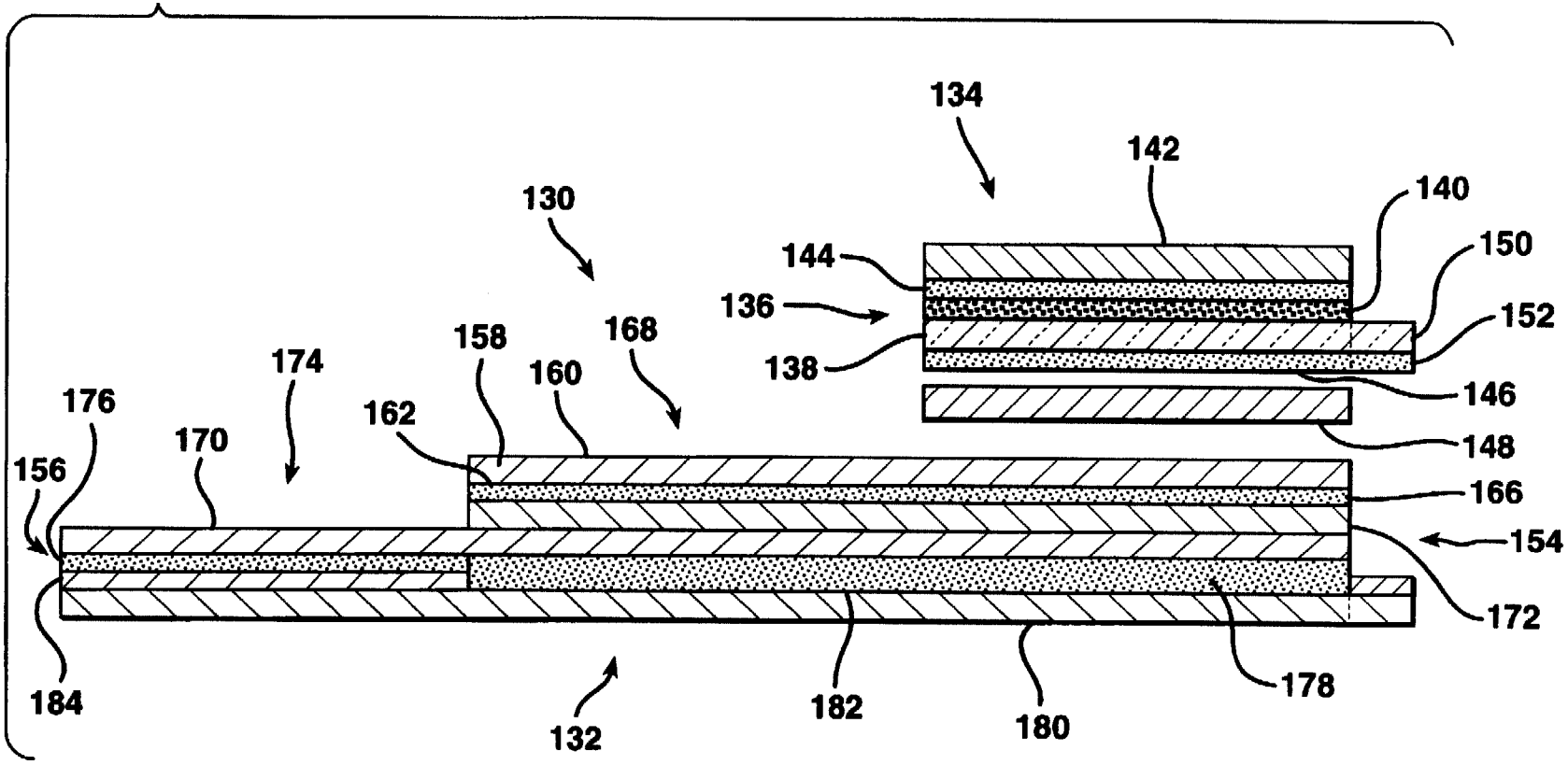
FIG. 3 is a cross-sectional view of an alternative version of the double-blinded label of the present invention.
Figure 4A:
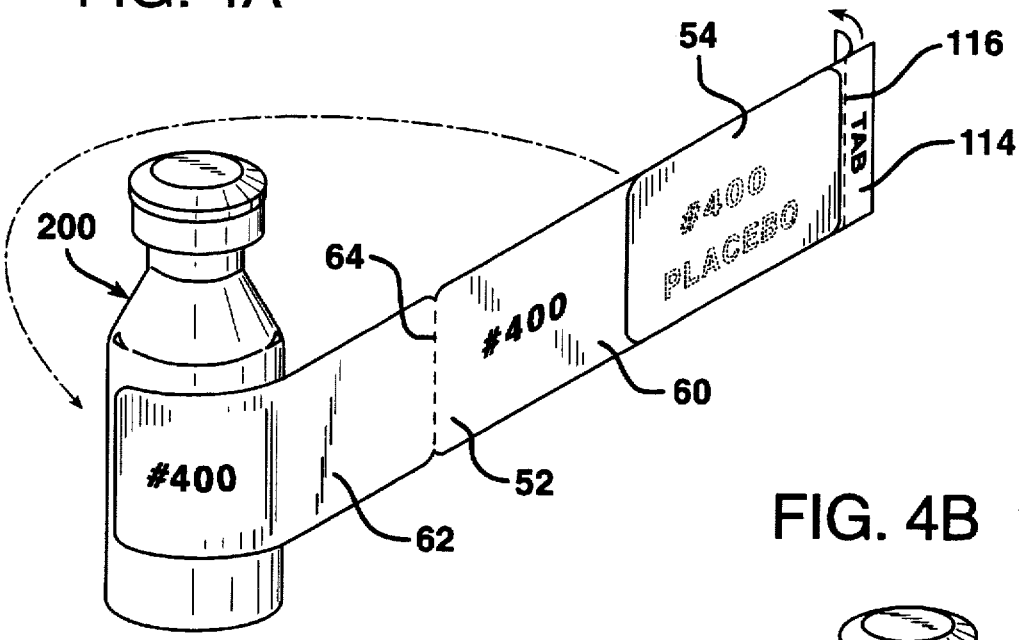
FIGS. 4*a–c* show a perspective view of the double-blinded label of the present invention being applied to a container and having the record portion of the label removed.
Figure 4B:
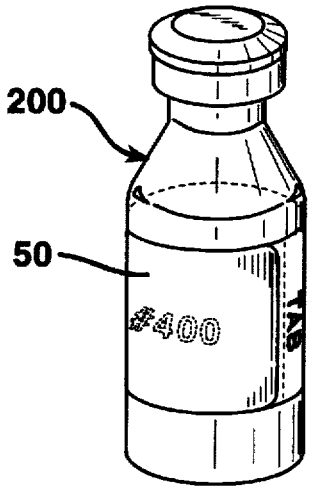
Figure 4C:
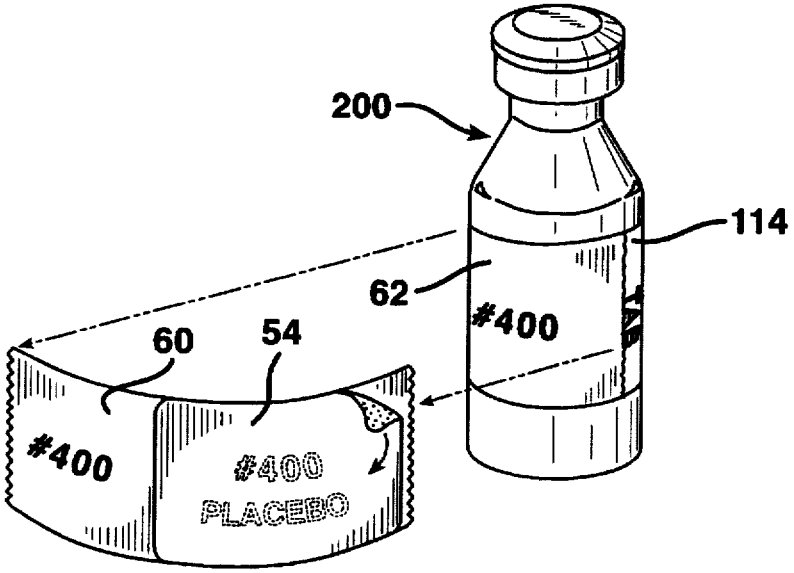

Turning now to FIG. 3, there is seen an alternative double-blind label 130 of the present invention. Double-blind label 130 comprises an identification label 132 and a blinding label 134. Blinding label 134 is essentially identical to blinding label 54 as described above. Blinding label 134 in its preferred embodiment includes an opaque layer 136 comprising a transparent film 138 coated with an opaque scratch-off coating 140. The opaque layer 136 is protected by a protective covering 142 secured with an adhesive layer 144. An adhesive layer 146 is coated to the bottom of opaque layer 136 to secure the blinding label 134 to identification label 132.

Adhesive layer 146 may be protected by release liner 148 before the blinding label 134 is applied. Also, blinding label 134 preferably includes a tab 150 which extends beyond the first end portion 154 of identification label 132. Tab 150 includes an adhesive 152 on the lower surface. However, as before, tab 150 may extend from the identification label 132. As in blinding label 54, the adhesive layers, 144, 146 and 152, in blinding label 134 are all preferably pressure sensitive adhesives.

Identification label 132 is, again, a multilayer label. The label 132 includes a first end portion 154 and a second end portion 156. The identification label 132 has a face stock layer 158. Face stock layer 158 has a first surface 160 and a second surface 162. The first surface 160 is adapted for receiving printer images from a printing device, as described for identification label 52. Face stock 158 comprises only a portion of the overall length of identification label 132. Face stock 158 comprises a first section 168 of the label 132. The first section 168 is designed for removal from the double-blinded label 130 for application to a medical record or chart. First section 168 may itself be subdivided into smaller sections (not shown) via lines of weakness or die cuts (not shown).

The second surface 162 of face stock 158, is in contact with the first surface 164 of an adhesive layer 166. Adhesive layer 166 is preferably a pressure sensitive adhesive. Adhesive layer 166 is adjacent a face sheet layer 170. Face sheet layer 170 is also formed from a sheet suitable for receiving printed images from a printer. The portion of face sheet 170 which lies in register with the first section 168 or face stock 158, is coated with a release coating 172. Release coating 172 releasably protects adhesive layer 166.

The remaining portion of face sheet 170, or in other words, that portion not lying in register with face stock 158, comprises the second section 174 of the identification label 132. Second section 174 comprises the section of double-blind label 130 which remains adhered to the container and identifies the contents of the container for testing purposes. Thus, the lower surface of face sheet 170 lying in register with second section 174 is coated with an adhesive layer 176, preferably a pressure sensitive adhesive. The lower surface of face sheet 170 lying in register with first section 168 is in contact with a layer of clean release adhesive 178. A clean release adhesive is, once again, an adhesive which will not leave a tacky-residue. The entire identification label 132 is then supported on a base sheet 180.

The upper surface 182 of base sheet 180 lying in register with first section 168 is in contact with the clean release adhesive layer 178. The upper surface 182 of base sheet 180 lying in register with second section 174 is coated with a layer of release coating 184. Release coating 184 releasably adheres adhesive 176 so that when base sheet 180 is removed, adhesive 176 is exposed for attaching the label 132 to a container.

Turning now to FIGS. *4a–4c*, there is seen the double-blinded label of the present invention applied to a suitable container. FIG. *4a* shows the double-blinded label 50 as shown in FIG. 6. In FIG. *4a*, double-blinded label 50 is applied to a container 200 by first removing base sheet 90 from the preferred double-blinded label 50. Removal of base sheet 90 leaves adhesive layer 70 lying in register with second section 62 exposed. Clean release adhesive layer 96 lying in register with first section 60 is also exposed. Lastly, removal of base sheet 90 exposes the adhesive layer 118 on tab 114.

Second section 62 is applied to the container 200 via adhesive layer 70. The label 50 is then wrapped or coiled around the container 200. Clean release adhesive 96 holds the first section 60 of the label to the container. Once completely wrapped, tab 114 holds the label 50 securely to container 200, as shown in FIG. *4b*. If a tab is not included on the label 50, then the label 50 may be held in place with the clean release adhesive 96. If needed, alternative holding means, such as a heat-shrink sleeve or rubber band, may be employed to hold the label 50 in place on the container 200. The labelled container 200 may then be shipped to a physician for administration of a medication in the container 200 to a patient in a study.

Once the medication is administered, first section 60 of the double-blinded label may be removed from the container 200 by tearing along the tab perforation line 116 and the section perforation line 64. First section 60 at this point is still blinded by blinding label 54. First section 60 can be secured to a medical chart or record of the patient by removing protective layer 82. Removing protective layer 82 exposes the portion of adhesive layer 70 lying in register with the first section 60. Adhesive layer 70 then securely holds the first section 60 to the medical record. Second section 62 meanwhile remains adhered to the container 200 as shown in FIG. *4c*.

In the event of an adverse reaction, the container 200 can be matched to the medical record using identification numbers on both the first section 60 and the second section 62. The contents of the container can then be identified by unblinding the first section 60 on the medical record. In the preferred label 50, the label may be unblinded by removing the protective coating 110 from the blinding label 54, removing the scratch-off coating 104, and viewing the blinded information through the transparent film 102.

Figure 5:
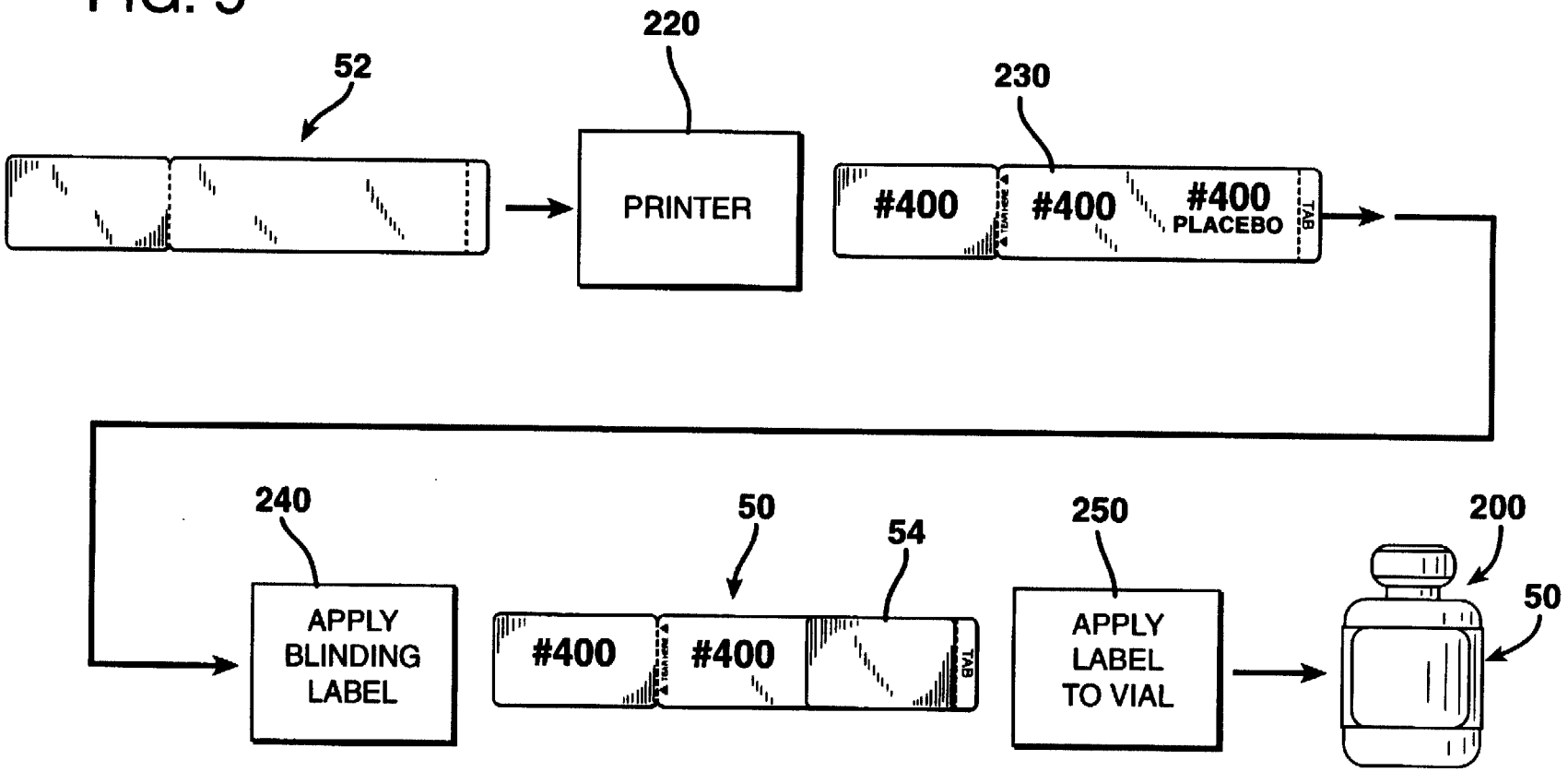
FIG. 5 is a schematic representation of the method of the present invention.

Turning now to FIG. 5, a schematic representation of the method of blind labelling a container according to the present invention is shown. The method comprises providing identification labels 52 in either continuous web format or single sheet format to printer 220. In continuous web format, the identification labels may be provided in roll, strip or pack form. The identification labels 52 may be provided in any desired dimension. However, identification labels 52 are preferably about 8 and ½ inches (21.6 cm) in length and about 1 and ⅝ inches (4.2 cm) in width. In continuous format, the labels are preferably separated by about ⅛ inches (0.32 cm) on the web. The identification labels 52 may be provided with pin feed holes in one or both margins of the web for passing through a printing device.

The identification labels 52 are passed through a printing device or system 220. The printing device 220 may be any known printing device known in the art such as, laser, ink jet, thermal transfer or impact printing device. Preferably, the printing device 220 is a laser printing device. Printing device 220 prints both variable and nonvariable information on identification label 52, as described above. Particularly, printing device 220 prints information to be blinded on the identification label 52.

The printed identification label 230 is passed to a label dispensing device 240 wherein a blinding label 54 is affixed to the area of the identification label to be blinded, forming double-blinded label 50. The label dispensing device 240 may be any known device capable of affixing one label to another in a specified position. Suitable devices are well-known and available from a variety of manufacturers. One device particularly useful in the present invention is Model 1200 Label Laminator available from the Standard Register Company of Dayton, Ohio.

Double-blinded label 50 is then applied to a suitable container 200. The double-blinded labels 50 may be applied to the container 200 either manually, via an automated dispenser for manual application to a container, or with a suitable automated label application device 250. Blinding labels may be of any suitable size to fit over the area of information to be blinded on identification label 52. Blinding labels 54 are preferably all identical. They carry no individualized information. Blinding labels 54 can also be supplied in continuous web or single sheet format. Label applicating device 250 may be any suitable device for applying a label to a container. Such devices are well-known and available from various manufacturers. Two such suitable devices are the Model 612 Bottle Labeller available from Ohio Electronic Machine of Salem, Ohio and the Model 5 Large Diameter Wrap labelling system available from Quadrel Labelling of Eastlake, Ohio.

The method as described may be either manually operated or, preferably, continuous and automatic. The double-blinded label 50 of the present invention provides the first completely automated capability for double-blinded labels. The steps of providing identification labels 52, printing the labels 230, applying the blinding label 54 and applying the double-blinded label 50 to a container 200 may all be automatically operated by microprocessor control. The advantage significantly reduces the amount of manpower, time and expense involved in preparing double-blinded labels.

Having described the invention in detail and by reference to the preferred embodiment thereof, it will be apparent that modifications and variations are possible without departing from the scope of the invention which is defined in the appended claims.

What is claimed is:

1. A double-blinded label comprising:

an identification label having first and second end edges and divided into at least first and second sections, said identification label comprising (i) a layer of face stock, said face stock having first and second surfaces, a printed image provided on at least a portion of said first surface of the face stock in said first section of the label, (ii) an adhesive layer having first and second surfaces, said first surface of said adhesive layer being in contact with said second surface of said face stock, (iii) a protective layer having first and second surfaces, said protective layer lying in register with said first section of said label but not in register with said second section of said label, at least a portion of said first surface of said protective layer having a release coating thereon, and at least a portion of said second surface of said adhesive layer being in contact with said release coating, and (iv) a base sheet having a first surface, a portion of said first surface of said base sheet which is lying in register with said first section of said label being coated with a clean release adhesive and being in contact with said protective layer; and, a blinding label adhered over said printed image on said identification label, said blinding label comprising an opaque layer having first and second surfaces and a blinding label adhesive layer having first and second surfaces, said first surface of said blinding label adhesive layer being in contact with said second surface of said opaque layer and said second surface of said blinding label adhesive layer being disposed over said printed image.

2. The label as claimed in claim 1 wherein said first and second sections are divided by a line of weakness.

3. The label as claimed in claim 1 wherein said portion of said first surface of said base sheet lying in register with said second section of said identification label includes a release coating thereon.

4. The label as claimed in claim 1 wherein said protective layer is a release liner and said first surface of said release liner is in contact with the portion said second surface of said adhesive layer which is lying in register with said first section of said identification label.

5. The label as claimed in claim 1 wherein said protective layer is a face sheet, said face sheet having first and second portions, said first portion of said face sheet lying in register with said face stock to comprise the first section of said identification label while said second portion of said face sheet comprises said second section of said identification label.

6. The label as claimed in claim 5 wherein said second surface of said face sheet protective layer in said second portion of said face sheet is coated with an adhesive material.

7. The label as claimed in claim 1 wherein said opaque layer of said blinding label is an opaque coating on a transparent film.

8. The label as claimed in claim 4 wherein said opaque coating is a scratch-off coating.

9. The label as claimed in claim 4 wherein said opaque layer further includes a protective covering on said opaque coating.

10. The label as claimed in claim 1 wherein said blinding label is adjacent said first end edge of said identification label and said opaque layer of said blinding label extends a distance beyond said first end edge forming a tab and said base sheet extends a distance beyond said first end edge coextensive with said tab.

11. The label as claimed in claim 1 wherein said face stock layer or said protective layer extends a distance beyond first end edge forming a tab and said base sheet extends a distance beyond said first end edge coextensive with said tab.

12. A double-blinded label comprising:

an identification label having first and second end edges and divided into at least first and second sections, said identification label comprising (i) a layer of face stock, said face stock having first and second surfaces, a printed image provided on at least a portion of said first surface of the face stock in said first section of the label, (ii) an adhesive layer having first and second surfaces, said first surface of said adhesive layer being in contact with said second surface of said face stock, (iii) a base sheet having a first surface, said first surface of said base sheet being coated with a release coating, said base sheet extending a distance beyond said first end edge of said identification label;

a blinding label adhered over said printed image of said identification label, said blinding label comprising (i) an opaque layer having first and second surfaces, and (ii) a blinding label adhesive layer having first and second surfaces, said first surface of said blinding label adhesive layer being in contact with said second surface of said opaque layer and said second surface of said blinding label adhesive layer being disposed over said printed image; and, a portion of said blinding label or said identification label extending a distance beyond said first end edge thereby forming a tab.

13. The label as claimed in claim 12 wherein said identification label further includes a protective layer disposed between said adhesive layer and said base sheet in said portion of said label lying in register with said first section, said protective layer having first and second surfaces and a release coating on said first surface.

14. The label as claimed in claim 13 wherein said portion of said base sheet lying in register with said first section of said identification label includes a clean release adhesive on the first surface.

15. The label as claimed in claim 12 wherein said tab forming portion comprises either said opaque layer or said face stock layer.

16. The label as claimed in claim 13 wherein said tab forming portion comprises said protective layer.

17. The label as claimed in 12 claim wherein said opaque layer of said blinding label is an opaque coating on a transparent film.

18. The label as claimed in claim 17 wherein said opaque coating is a scratch-off coating.

19. The label as claimed in claim 12 wherein said opaque layer further includes a protective covering on said opaque coating.

* * * * *